US006715760B2

(12) United States Patent
Miller

(10) Patent No.: US 6,715,760 B2
(45) Date of Patent: Apr. 6, 2004

(54) PROJECTILE IMPACT LOCATING DEVICE

(76) Inventor: Stuart Ray Miller, 163 Lexington St., Apt. #18, Auburndale, MA (US) 02466

( * ) Notice: Subject to any disclaimer, the term of this patent is extended or adjusted under 35 U.S.C. 154(b) by 227 days.

(21) Appl. No.: 09/882,565

(22) Filed: Jun. 15, 2001

(65) Prior Publication Data

US 2001/0053722 A1 Dec. 20, 2001

Related U.S. Application Data

(60) Provisional application No. 60/212,191, filed on Jun. 16, 2000.

(51) Int. Cl.[7] ..... F41J 5/04
(52) U.S. Cl. ..... 273/371
(58) Field of Search ..... 273/371, 374, 273/376; 463/42

(56) References Cited

U.S. PATENT DOCUMENTS

| | | | | |
|---|---|---|---|---|
| 3,992,212 A | | 11/1976 | Youtsey et al. | |
| 4,057,251 A | | 11/1977 | Jones et al. | |
| 4,155,262 A | | 5/1979 | Wong et al. | |
| 4,433,223 A | | 2/1984 | Larson et al. | |
| 4,495,236 A | | 1/1985 | Obara et al. | |
| 4,659,090 A | * | 4/1987 | Kustanovich | 273/376 |
| 4,949,972 A | | 8/1990 | Goodwin et al. | |
| 5,518,250 A | | 5/1996 | Lu et al. | |
| 5,613,685 A | | 3/1997 | Stewart et al. | |
| 5,669,608 A | | 9/1997 | Thomson et al. | |
| 5,788,244 A | | 8/1998 | Hui et al. | |
| 5,857,912 A | * | 1/1999 | Freitag et al. | 463/42 |
| 6,047,968 A | | 4/2000 | Lu et al. | |
| 6,089,571 A | * | 7/2000 | Cho | 273/371 |
| 6,116,607 A | | 9/2000 | Cho | |
| 6,155,570 A | | 12/2000 | Allison | |
| 6,215,390 B1 | | 4/2001 | Lin | |

* cited by examiner

*Primary Examiner*—Andrew M. Dolinar

(57) ABSTRACT

A device is described for locating the positions of impact of projectiles as they strike a target by detecting the pressure or force delivered upon impact. A sensor layer is made of resistive ink applied to a non-conductive material. An electrical current is applied to the resistive ink layer, and when the force of impact from the projectile acts upon the sensor layer a change in impedance is measured via standard circuits and electronics. The magnitude of the impact force can also be correlated to the magnitude of the resulting change in impedance. The resistive ink layer can be divided into smaller sections to provide location data to the output electronics. Each section of the sensor layer connects to the output electronics via sensor connectors made from either conductive inks or standard wires. Output electronics connect to a standard display device. A pressure transfer layer may be present in front of the sensor layer when the projectile has a higher velocity. This pressure transfer layer will protect the sensor layer from damage. For projectiles of high velocity an additional front layer may be present which absorbs the impact and stops the projectile. The front layer is made from the appropriate material for the particular projectile. Except in the case of very low velocity projectiles, the projectile never directly contacts the sensor layer. The resistive ink layer can also be continuous and not subdivided. Electrical nodes located on the periphery of the sensor layer determine the impact location by impedance tomography.

18 Claims, 8 Drawing Sheets

PROJECTILE IMPACT LOCATING DEVICE

CROSS REFERENCE TO RELATED APPLICATIONS

This application is entitled to the benefit of Provisional Patent Application Ser. No. 60/212,191 filed Jun. 16, 2000.

STATEMENT REGARDING FEDERALLY SPONSORED RESEARCH AND DEVELOPMENT

Not applicable

BACKGROUND

1. Field of Invention

This invention relates to devices for sensing the location of projectiles as they hit a target, specifically to dartboards that automatically sense the location of each dart as it hits the dartboard, scoring the dart instantaneously.

2. Description of Prior Art

Traditional dartboards are made of tightly packed fibers for use with "steel-tipped" darts. These boards have existed for some time, however players must score their own darts. In order to make a dartboard that automatically scores the darts, an electronic board was invented that is made of plastic and has many small holes in it for use with plastic-tipped darts. When a dart strikes a particular section of the board the section is depressed sending an electronic signal that counts the dart. While electronic dartboards for plastic or "soft-tipped" darts have become popular in many parts of the country, in part because they are self-scoring, they do not have the same appeal to many people as traditional steel-tipped darts.

These two types of darts/dartboards, namely steel-tip and soft-tip, are not interchangeable. Steel-tipped darts are typically heavier, and the tip has a larger diameter than soft-tipped darts. The larger diameter and greater mass of the steel-tipped darts mean that they cannot be used with the plastic electronic boards as this would permanently damage the board.

The disadvantage of the electronic soft-tipped dartboards is not in their function, but simply that it is not the same game as the traditional steel-tipped darts. One disadvantage of soft-tipped darts is demonstrated by the fact that the darts are lighter and do not have the same feel as the steel-tipped darts, also the plastic tips often bend and break and constantly need to be replaced. The disadvantage of the traditional steel-tipped darts is that they do not automatically score the darts.

Several automatic-scoring dartboards have been developed for use with steel-tipped darts. U.S. Pat. No. 6,089,571 to Cho (2000) and U.S. Pat. No. 6,215,390 to Lin (2001) are similar in describing a relatively complex design in which separate sisal blocks are depressed when a dart strikes the dartboard. The momentum from the dart presses the sisal block which activates a touch switch completing an electrical circuit, and identifying the section of the board that was struck by the dart. The disadvantages of this design are numerous. The board itself is redesigned and thus more costly to manufacture. Changing the board so that separate sections of the board can be depressed changes the game significantly. Darts that would normally have remained in the board, are now more likely to fall out.

There are several more devices that consist of separate blocks or sections that are depressed when a dart or projectile strikes that particular section. One of these is described in U.S. Pat. No. 5,613,685 by Stewart et al. (1997). The dartboard is made from conductive blocks that are depressed upon impact and thus complete a circuit. The function of this device is similar to the one described by Lin above, and also suffers from the same disadvantages. Similar devices are described by Cho & Lin in U.S. Pat. No. 6,116,607 (2000), and by Lu et al. in U.S. Pat. No. 6,047,968 (2000). These devices suffer from the disadvantages of changing the game significantly, and increasing costs. Another disadvantage of these boards is that they do not register any quantity to the force of impact.

Another system for locating the presence of a dart in a dartboard detects a change in electrical conductivity. U.S. Pat. No. 6,155,570 by Allison (2000) describes a device in which the bristle fibers of the dartboard are coated with a conductive material such as graphite. The major disadvantage of this dartboard is that the graphite comes off on the darts and gets on the hands of the players.

There is one automatic electronic scoring device for steel-tipped darts that is currently on the market. This device scans the surface of the dartboard with lasers and senses the location of the darts by detecting the light reflected off the darts. While this device functions fairly accurately, its major disadvantage is its high cost. The current retail price for the device is approximately 20 times the price of a standard non-scoring bristle dartboard. The accuracy has been reported to be on the order of 99%.

There have also been several projectile-locating devices developed that may or may not be used with darts. U.S. Pat. No. 5,669,608 to Thomson et al. (1997) discloses a complex multi-layer device in which the projectile must penetrate several layers of the detector. When a projectile breaks the lamina-type parallel planes, the impact location is detected as a change in voltage. This has the obvious disadvantage that the detector is penetrated and after much use would cease to function properly.

A device by Kustanovich in U.S. Pat. No. 4,659,090 (1987) detects impact locations in a relatively complex multi-layer system. While the detection system involves the measurement of changes in impedance when a force impacts a target, a prohibitively large number of layers are involved. For example, the preferred embodiment of the invention requires 11 layers to provide impact locations for just 4 sections.

Another device detects the location and speed of a projectile as it strikes a target based on the acoustic shockwaves produced upon impact. This design is described in U.S. Pat. No. 5,447,315 by Perkins (1995). With the sound detectors located on the periphery, the location of the impact is determined by the exact time that each detector senses the acoustic shockwaves. The speed of the projectile is estimated by the magnitude of the shockwaves. The device requires a special layer in which the projectiles strike, the layer designed to produce a loud sound with the impact. This device is not practical for use with the standard bristle dartboard since very little sound is produced with the impact of a dart in the sisal fibers.

There are several disadvantages of regular traditional non-scoring bristle dartboards. One disadvantage is that they cannot interface with a computer. Incorporating a computer interface allows many more games to be played, the most prominent of which is the ability to play through the Internet with a player at a different location.

Another disadvantage of current dartboards as well as the devices described above (except Kustanovich, 1987, and Perkins, 1995) is that they do not provide any measure of the force of impact of the dart. Playing darts well requires the ability of the player to throw each dart consistently with very precise motions. One measure of this precision is the force of the impact to the dartboard. By showing the player the force of each dart upon impact it will be possible for the player to develop a consistent and accurate throw. Currently there are no dartboards that quantify the force of impact of the dart to the dartboard.

While there are working devices which can detect the location of darts as they hit the dartboard, all such devices heretofore known suffer from a number of disadvantages:

a) currently there is are few working auto-scoring electronic dartboards made from traditional sisal fibers available to consumers, and these do not function with 100% accuracy;

b) the electronic dartboards currently being made use lighter darts with plastic tips that often break and have to be replaced. These darts do not have the same feel as the original, traditional darts;

c) although working devices for detection of all types of darts have been made, they are complex and expensive to manufacture, and they change the game significantly;

d) with traditional bristle dartboards, players must know all the games themselves. The board itself does not offer and suggest different dart games to play;

e) currently there are no traditional dartboards that allow players to play the game of darts through an internet connection, allowing players from virtually anywhere in the world to play against each other;

f) current dartboards do not quantify the force of impact of the darts.

SUMMARY

In accordance with the present invention, an electronic device for detecting projectile impact locations comprises an impact-absorbing front layer that absorbs a large part of the initial force of impact. The force of impact is transferred to a sensor that sends the impact magnitude and location data in the form of a standard electronic signal (such as a small change in impedance) to standard circuitry and a display or computer-screen.

Objects and Advantages

Accordingly, several objects and advantages of my invention are:

a) to provide an electronic traditional sisal fiber dartboard that automatically senses and records the location of each dart as it strikes the dartboard, with such a device being >99% accurate and relatively inexpensive;

b) to provide a method of scoring darts that utilizes the traditional steel-tipped darts with their superior quality and feel; the steel-tips being permanent, and do not need constant replacing;

c) to provide a method of automatically scoring the game of traditional steel-tip darts that utilizes a detection technology that is inherently simple and inexpensive, and will not significantly change the game itself;

d) to provide an electronic bristle dartboard that has a wide variety of pre-programmed dart throwing games;

e) to provide an electronic bristle dartboard that allows dart players to play through the internet;

f) to provide an electronic bristle dartboard that provides a display of the impact force of each dart thrown.

Further objects and advantages are to provide a bristle dartboard that does not require the players to keep score of their game. In league play this will speed things up considerably and may even allow more games to be played in a given match. This electronic bristle dartboard also will allow the use of the heavier, traditional steel-tip darts, and will not change the game of darts in any way except to free the players from the need to keep score of their darts. Still further objects and advantages will become apparent from a consideration of the ensuing description and drawings.

DRAWING FIGURES

Figure 4A:
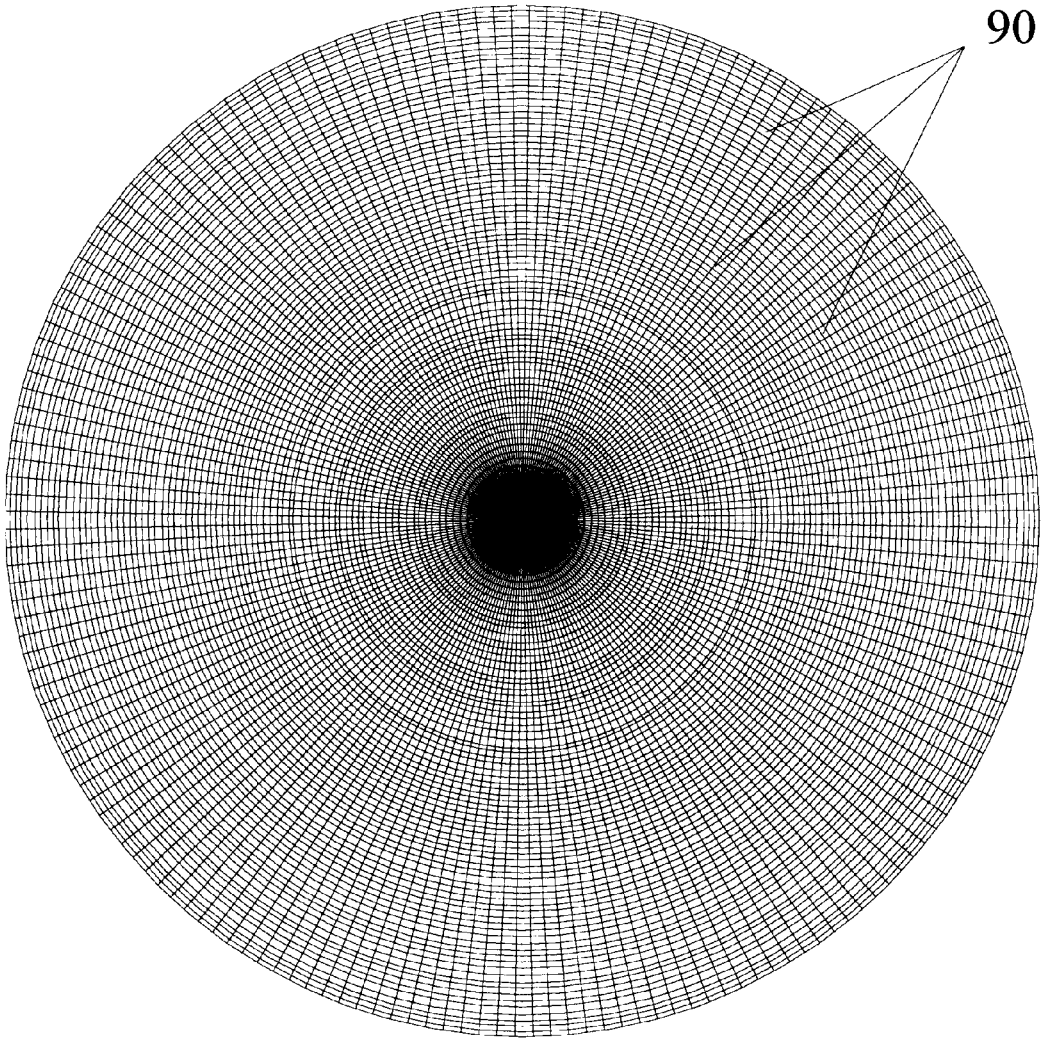

FIG. 4*a* shows a front view of an alternative sensor in which the sensor is divided into small pixels making a radial coordinate system.

Figure 4B:
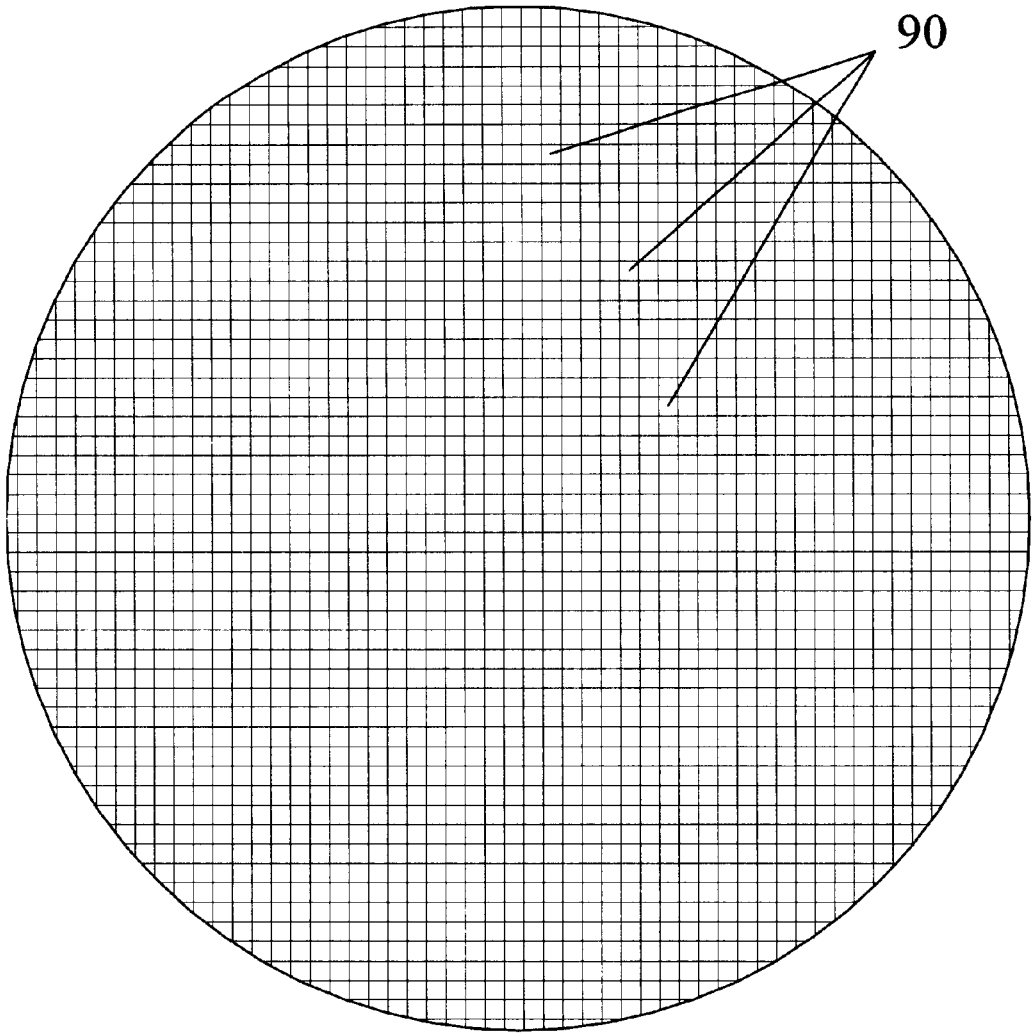

FIG. 4*b* shows a front view of an alternative sensor in which the sensor is divided into small pixels making a Cartesian coordinate system.

Figure 5:
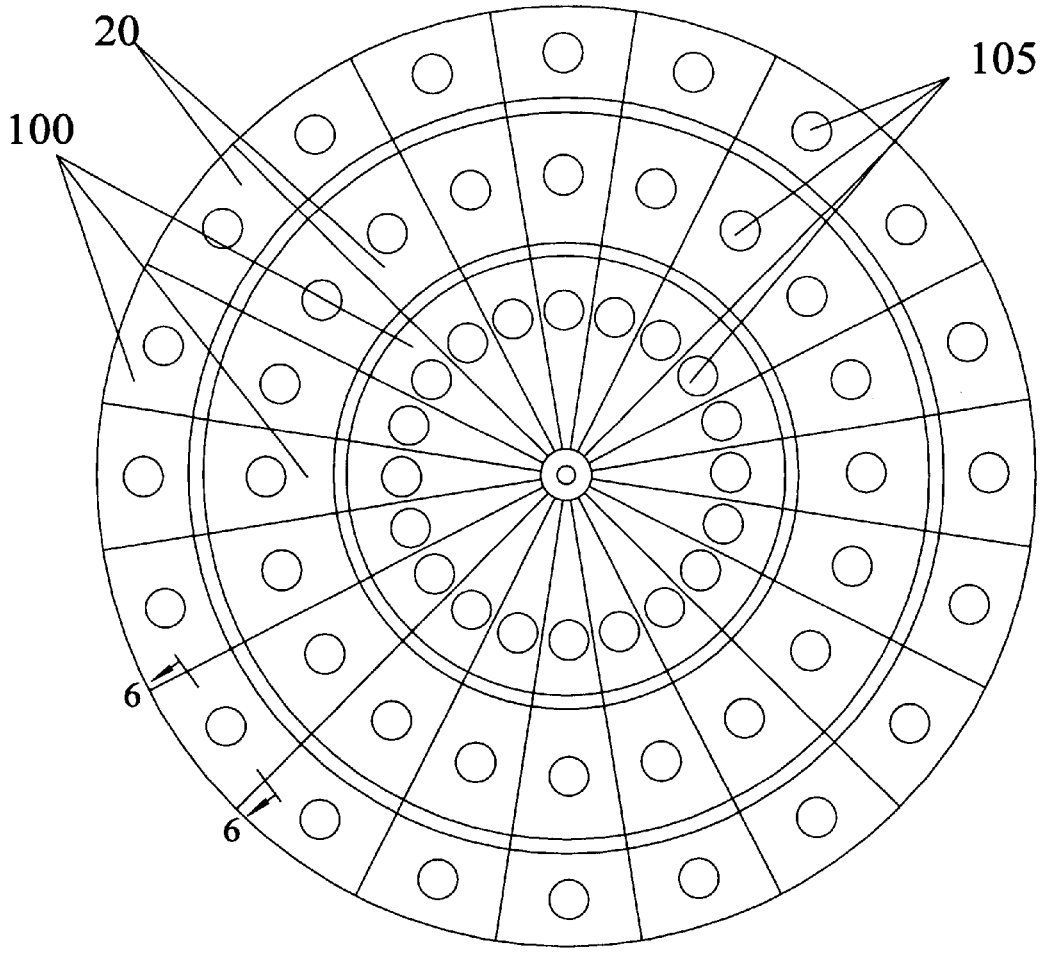

FIG. 5 illustrates an alternative embodiment of the pressure transfer layer in which the impact energy is transferred to a smaller area which matches a pressure sensor section.

Figure 6:
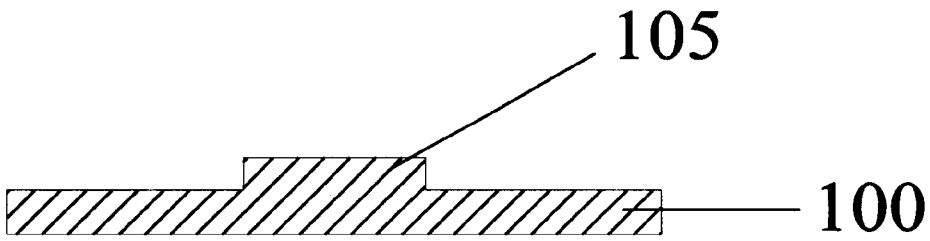

FIG. 6 shows a sectional view of a typical pressure transfer section.

Figure 7:
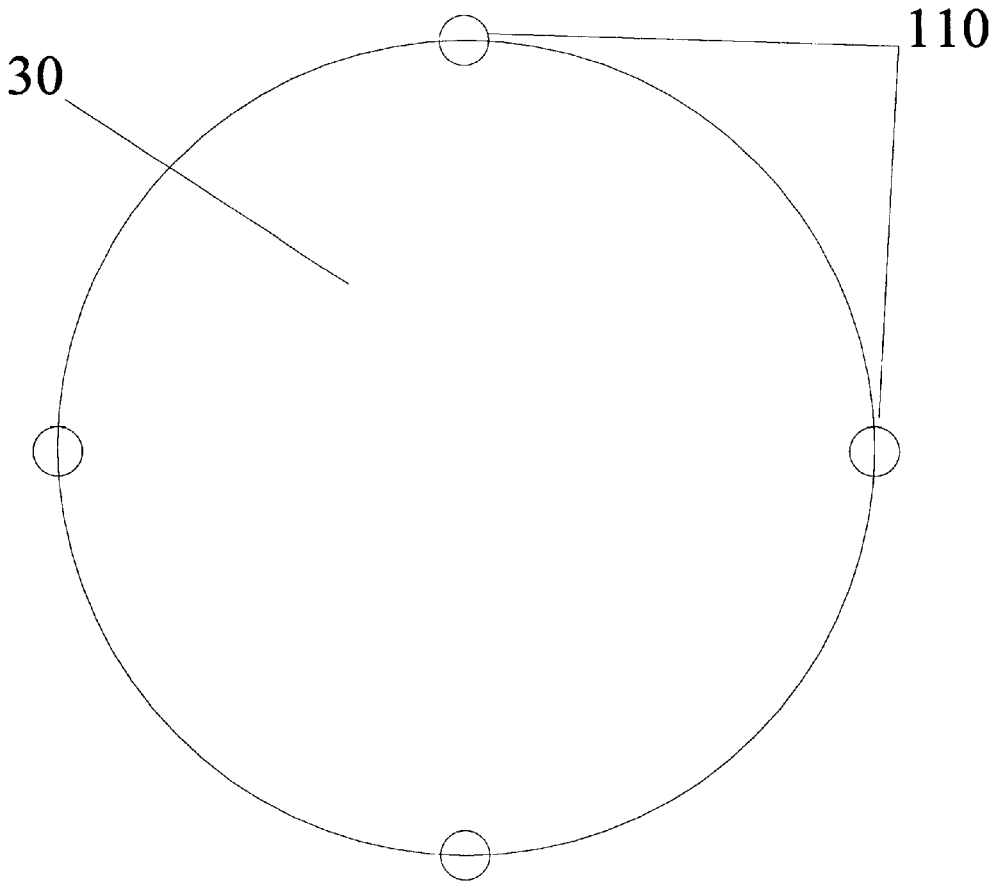

FIG. 7 depicts an alternative embodiment in which the entire pressure sensor is a layer of resistive material. It is not subdivided into smaller sections or pixels.

| | |
|---|---|
| 5 | fibers |
| 10 | impact-absorbing layer |
| 15 | dart/projectile |
| 20 | predetermined pattern |
| 25 | pressure transfer layer |
| 30 | pressure sensor layer |
| 35 | mounting layer |
| 40 | readout connectors |
| 50 | separate sensor sections |
| 55 | sensor connectors |
| 60 | sensor base layer |
| 70 | resistive/conductive ink |
| 80 | sensor protective layer |
| 90 | separate transfer pixels |
| 100 | pressure transfer sections |
| 105 | protruded section |
| 110 | electrical nodes |

DESCRIPTION—FIGS. 1–3—PREFERRED EMBODIMENT

Figure 1:
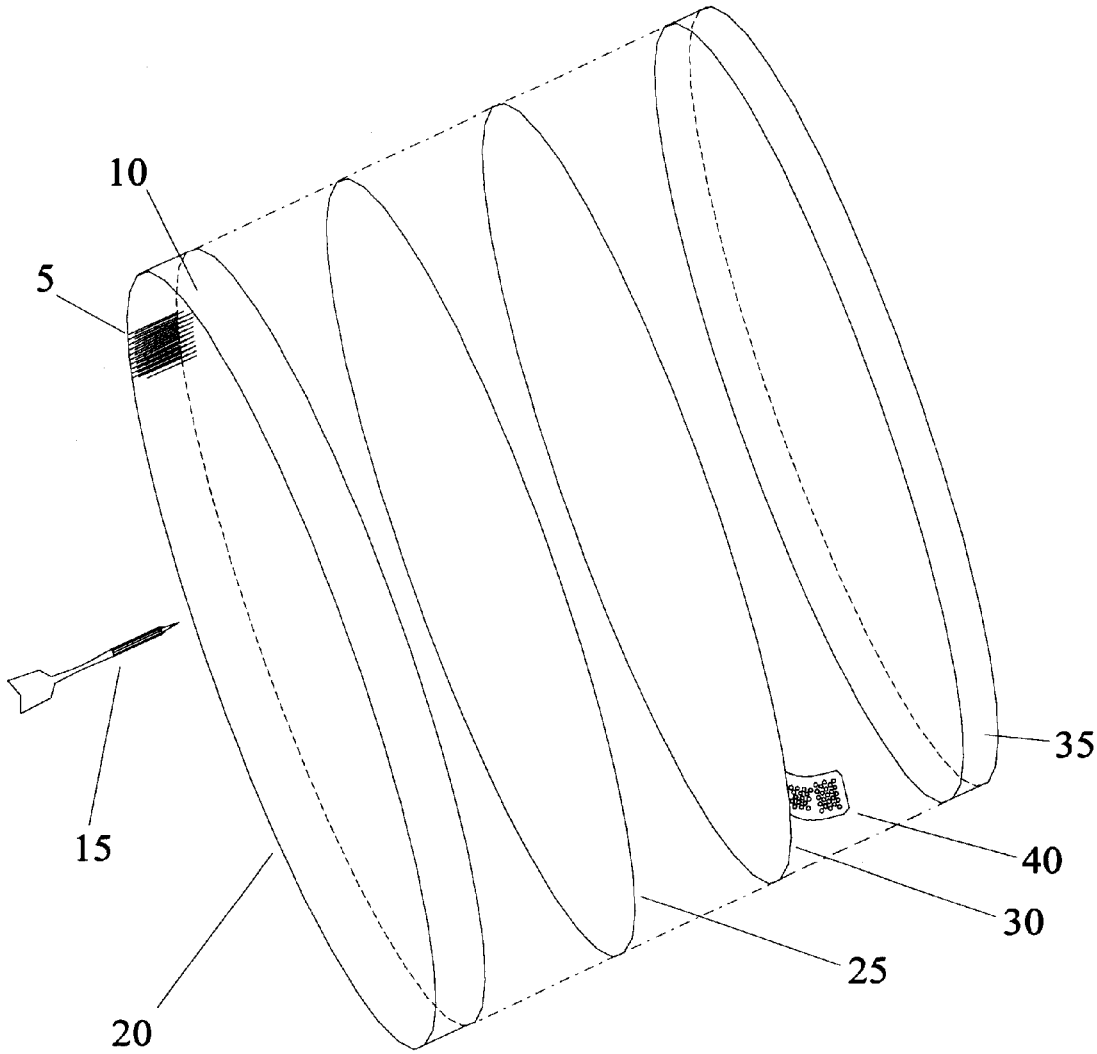
FIG. 1 shows an exploded view of my invention.

A preferred embodiment of the present invention is illustrated in exploded view in FIG. 1. An impact-absorbing layer 10 consists of standard sisal fibers 5 identical to those used in current standard bristle dartboards. These fibers 5 are tightly packed throughout the impact-absorbing layer 10 (for simplicity, only some are shown), and are arranged perpendicularly to a pressure transfer layer 25 and a pressure sensor layer 30. A dart 15 strikes the impact-absorbing 10 of the dartboard. The front of dartboard 20 is patterned in color and sections are separated with wire exactly as a standard dartboard. A pressure sensor layer 30 is located directly behind the pressure transfer layer 25, and may be attached with an appropriate adhesive. the pressure transfer layer 25 could be made of rubber, plastic or other somewhat flexible material Behind the pressure sensor layer 30 is a suitable mounting layer 35. This mounting layer 35 could be made from cork, wood, or a wide variety of materials that provide a firm surface for supporting the pressure sensor layer 30. Pressure sensor layer 30 has readout connectors 40 that connect to conventional electronics (not shown). For alignment purposes and to hold everything together, several holes (not shown) may be placed at regular intervals around the outside of the impact-absorbing layer 10, the pressure transfer layer 25 and the pressure sensor layer 30. These holes which will number at least three will match up so that pins or bolts (not shown) can go through all three parts to assure proper alignment. Thus these layers shown in FIG. 1 can be held together by nuts and bolts or other standard means such as an appropriate adhesive, or other suitable means. An outer band made of metal or other suitable material (not shown) wraps around the outside of the entire apparatus, and provides additional support.

Figure 2:
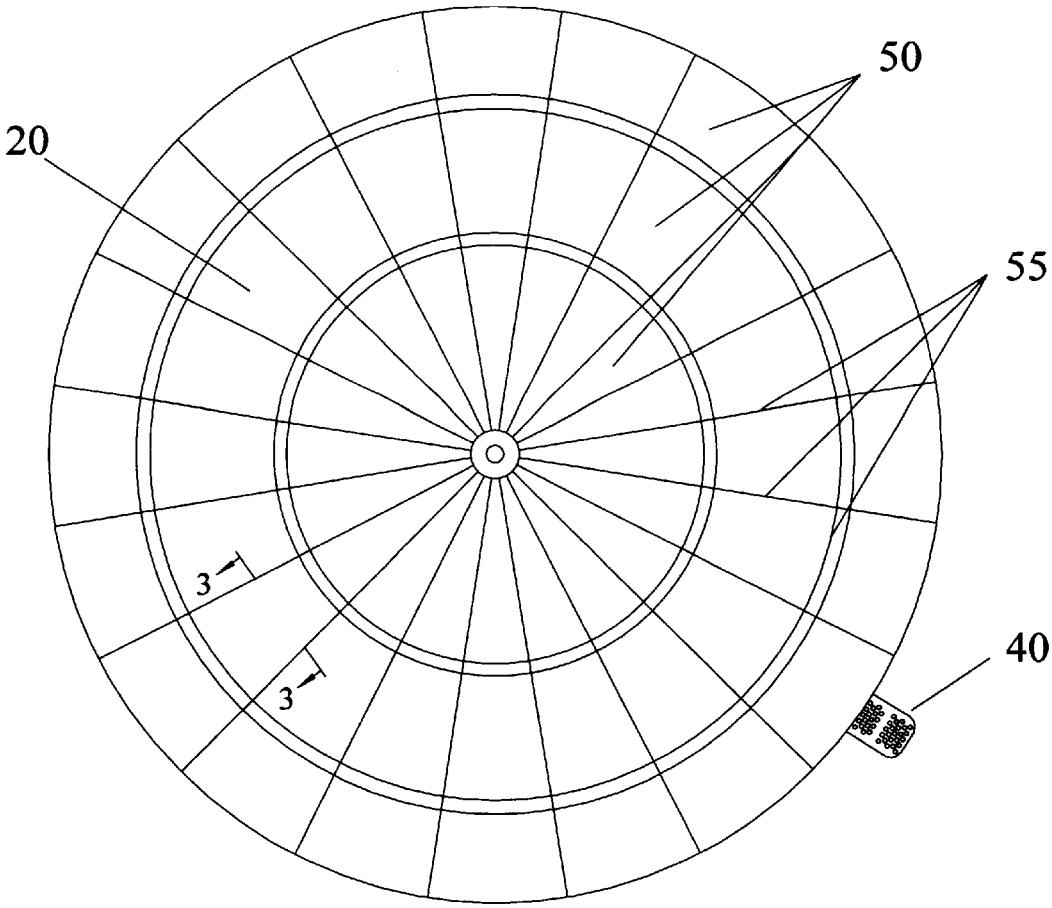
FIG. 2 is a front view of the pressure sensor layer, which has sections corresponding to the sections of a traditional dartboard.

FIG. 2 shows a front view of the pressure sensor layer 30. The pressure sensor layer 30 is subdivided into separate sensor sections 50 that match the predetermined pattern 20 as shown on the impact-absorbing layer 10. Each section 50 of the pressure sensor layer 30 matches up exactly with the appropriate section of the dartboard. The electrical signal from each section is readout via sensor connectors 55 to the readout connector 40. These sensor connectors 55 can be made from small wires or conductive ink, which has been applied in the small gaps between the separate sensor sections 50.

Figure 3:
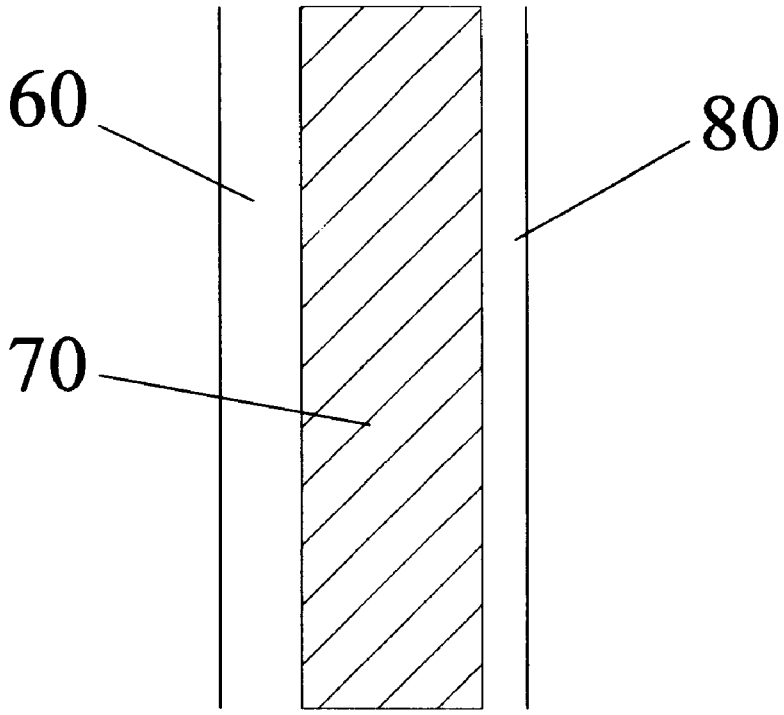
FIG. 3 is a sectional view of a typical pressure sensor.

A sectional view of a typical sensor section 50 is shown in FIG. 3. The typical pressure sensor layer 30 uses pressure sensitive or resistive inks 70 to detect a change in pressure. A typical sensor is made by coating resistive ink 70 on a sensor base layer 60, which is made from non-conductive material such as mylar, plastic, rubber, silicone or other suitable material. The coating 70 can be applied by any standard means such as screen printing, spin-coating, sputter deposition, vapor deposition, or a host of other options. The pattern is formed by selectively coating or masking sections of the sensor base layer 60 as deemed appropriate for matching the predetermined pattern 20. To protect the ink coating 70 a thin protective layer 80 may be added to sandwich the ink between two layers as shown in FIG. 3. Either the base layer 60 or the protective layer 80 (or both) must be somewhat flexible. Standard wires or wires made from conductive ink (not shown) can be used to connect each sensor section 50 to the readout connectors 40.

FIGS. 4–5—Additional Embodiments

FIG. 4*a* shows a front view of the pressure sensor layer 30 with a coordinate system. This drawing shows the polar coordinate system, however a Cartesian coordinate system as shown in FIG. 4*b* could also be used. The entire sensor is divided into very small pixels 90 that then correlate to the different targeting sections according to the predetermined pattern 20.

FIGS. 5 and 6 show an additional embodiment in which the pressure transfer layer 25 is divided into pressure transfer sections 100 that match up to the predetermined pattern 20. Each pressure transfer section 100 has a smaller protruding section 105 that matches to sensor sections 50. The pressure transfer sections 100 not only serve to protect the sensors from the direct impact of the projectile, but also are structured such that the force of impact is transferred from a larger area to a smaller area. Thus a force acting on the edge of the larger area produces a tongue or rotational force that is transferred to the smaller area and the corresponding pressure sensor section 50.

FIG. 7 shows an alternative embodiment in which the pressure sensor layer 30 is made with a continuous coating of resistive ink 70. Electronic nodes 110 are placed around the periphery of the sensor.

OPERATION OF THE INVENTION

The manner of playing darts with the automatic scoring dartboard is almost identical to that of dartboards in present use. Darts 15 are thrown at the dartboard striking the dartboard impact-absorbing layer 10. A dart 15 sticks into the dartboard by lodging in between the tightly packed sisal fibers 5. The present invention adds a pressure sensor layer 30 located between the impact-absorbing layer 10 and the mounting layer 35. As the dart 15 lodges between fibers 5 of the dartboard impact-absorbing layer 10, the energy from the impact of the dart 15 is absorbed and transferred to the sensor layer 30. Located in front of the sensor layer 30 is a pressure transfer layer 25 that will prevent the dart from striking the sensor layer 30 directly, as this may damage the sensor. This pressure transfer layer 25 is constructed of a material that will absorb some of the impact of the dart 15, and directly transfer the energy to the pressure sensor layer 30. The pressure sensor itself is composed of resistive ink 70 made from a polymeric binder incorporating semi-conductive particles so that the ink when dried and cured produces a change in impedance under external influence such as pressure. The change in impedance can be measured and is indicative of the magnitude of the pressure applied. With a constant current (I) applied to the ink, any force received by the ink causes a change in impedance, which can be measured as a change in voltage or resistance. This is according to Ohm's law V=IR where V is voltage, I is current, and R is resistance. The signal can be routed through standard circuitry, which may include an amplifier configured as a discriminator. The sensor electronics can be configured to control the sensitivity of the sensor to the impact of the dart 15. Thus, the impact from the dart 15 causes a change in impedance in the resistive/conductive ink 70 sending a signal via the sensor connectors 55 to readout connectors 40 and then to conventional sensor electronics (not shown). In addition, the sensor electronics can be designed to discriminate between an impact from a dart 15 and an impact from some other source such as a person's finger. This would be accomplished by distinguishing the rise-time of the signal and identifying an impact only with the signature rise-time associated with a dart 15 impact.

The mounting layer 35 anchors and stabilizes pressure sensor layer 30 and allows it to remain in good contact with the pressure transfer layer 25. The electronics displays the result of the impact in a standard digital display such as an LED or LCD display. Alternatively this result could be displayed on a remote display, the electronic signal transmitted via cables or wires or wirelessly. This signal could also be transmitted via cables or wirelessly to a computer.

An additional embodiment shown in FIG. 4 includes a pressure sensor layer 30 with a coordinate system which could have the pixels arranged radially (FIG. 4*a*) or in an x-y or Cartesian coordinate system (FIG. 4*b*) instead of a pattern that matches the predetermined pattern 20 exactly. In this embodiment the pressure from the dart 15 is detected in a pixel 90 on the pressure sensor layer 30 and the resulting signal is sent to the readout electronics 40. The electronics then translate the coordinate into the appropriate dartboard section with this output shown in the digital display or transmitted to the computer.

In the alternative embodiment shown in FIGS. 5 and 6, the pressure transfer layer 25 is actually made up of separate pressure transfer sections 100 that match the predetermined pattern 20 on the front. Each separate transfer section 100 reduces to a smaller protruded section 105. Each small protruded section 105 matches up to a separate sensor section 50 of the pressure sensor layer 30. In this way the energy from an impact to any of the separate pressure transfer sections 100 will be transferred via the protruded section 105, and detected by the separate sensor sections 50.

In the alternative embodiment shown in FIG. 7 the pressure sensor layer 30 is continuous, and not subdivided into separate sections or pixels. The impact location is determined by sensing the change in impedance at the electrical nodes 110 which are placed around the periphery of the pressure sensor layer 30. The impact location can be determined very precisely based on the principal of minimal resistance, and the well-known science of impedance tomography.

Another embodiment includes a variation in the output electronics (not shown). Instead of having the outputs go to a simple digital display board, the outputs could connect to a computer via a parallel, serial, USB or wireless connection. A program could be written that would tally up the darts and allow the game of darts to be played on a computer. One distinct and great advantage to this embodiment is that this would allow the game of darts to be played through the Internet; a person could theoretically play a game of darts against another person anywhere in the world. The program could also include a camera to view the darts as they are thrown.

There are some embodiments that would not benefit greatly with the addition of more drawings, since it is basically the projectile that is different, and not the detection apparatus itself. The detection apparatus as shown in FIG. 1 consists of an impact absorbing layer 10, a pressure transfer layer 25, a pressure sensor layer 30, and a mounting layer or backboard 35. The sensor layer 30 may be the only necessary layer for some applications. For instance, if the projectiles are soft darts or foam balls, neither an impact-absorbing layer 15 nor a pressure transfer layer 25 would be required. Thus a simplified device for detecting projectiles of small mass would consist of the pressure sensor layer 30, and could simply be hung on the wall.

Other alternate embodiments could be devised based on the projectile being detected. For high velocity projectiles such as missiles, bullets, or arrows, a relatively thick impact absorbing layer would be needed.

Thus alternate embodiments can be conceived for many applications involving various projectiles such as those used in baseball, tennis, golf, hockey, air-hockey, toy guns, blow guns, and so on. The predetermined pattern 20 could be modified to be appropriate for each application. The pressure sensor layer 30 as shown in FIG. 3 would be designed for the forces associated with each application, and may be calibrated to sense either a high velocity impact or a low velocity impact as needed. A similar mounting layer 35 and readout electronics 40 would be required, as well as the appropriate display device.

For use in baseball, for instance, pitchers could use the device to score the accuracy, precision and even force of impact of their pitching. The impact-absorbing layer 10, pattern 20 and pressure sensor layer 30 can be modified appropriately to simulate the pitching strike zone. This embodiment could also be modified to be part of a baseball pitching arcade game.

Conclusion, Ramifications, and Scope of Invention

Accordingly the reader will see that the electronic scoring bristle dartboard provides a reliable, effective, and economical device that will automatically score the game of steel-tip darts. This dartboard will eliminate the need for steel-tip dart players to meticulously score their darts after each turn, thus speeding up game-play. This electronic device will have the well-known dart games pre-programmed into its memory so that players will have a variety of games to play.

Although the description above contains many specificities, these should not be construed as limiting the scope of the invention but as merely providing illustrations of some of the presently preferred embodiments of this invention. Many other variations are possible. For example, the pattern for the dartboard and sensors may not follow the exact design of the traditional dartboard; it could have a baseball field or any other configuration of shapes and sizes; one could easily make a game of "dart checkers" for example. The front portion of the dartboard could alternatively be made of a different type of fiber. The overall size of the dartboard may not be the exact dimensions of the traditional dartboard; for example a larger version could be made for the handicapped, or a smaller desktop version could be made. A similar device could be made to automatically score the arrows in archery or even bullets at a shooting range.

This invention has a wide variety of possible alternative embodiments. Virtually any projectile targeting application could be modified with the appropriate pressure sensor and pattern. For example, the shape of the entire device could be rectangular, oval, trapezoidal, triangular, etc.; and likewise the shapes of the sensors and corresponding targeting sections could be of any desired shape or size.

Thus the scope of the invention should be determined by the appended claims and their legal equivalents, rather than by the examples given.

I claim:

1. A scoring device for detecting the location of impact of projectiles, comprising:

a) a sensor layer composed of at least one resistive ink coating with means to produce change in impedance when a force acts on said sensor, b) electronic readouts with means to transfer said changes in impedance to output electronics.

2. The scoring device of claim 1 wherein said sensor layer is divided into a plurality of separate sections in a predetermined pattern.

3. The scoring device of claim 2 further including a layer in front of said sensor with means to protect said sensor from damage from said impact forces.

4. The scoring device of claim 3 wherein said protective layer is structured such that said impact force is transferred from a larger area to a smaller area.

5. The scoring device of claim 1 wherein said layer of sensors is divided into a multitude of pixel elements.

6. The scoring device of claim 5 wherein said pixel elements are arranged in a Cartesian coordinate system.

7. The scoring device of claim 5 wherein said pixel elements are arranged in a polar coordinate system.

8. The scoring device of claim 1 wherein said electronic readouts are located peripherally and contiguously to said sensor layer whereby impact locations are determined by impedance tomography.

9. The scoring device of claim 1 wherein said change in impedance is proportional to said force of impact.

10. A method for detecting the impact locations of projectiles as they strike a planar target area with the use of a plurality of sensors and electronic readouts, comprising:

a) providing a change in impedance when a projectile strikes a sensor, each of said sensors made from resistive ink material with bias applied across said resistive ink material, said bias being applied via conductive material contiguous to said resistive ink material, b) transmitting said change in impedance from said conductive material to said electronic readouts, said electronic readouts further transmitting said change in impedance to output electronics.

11. The method of claim 10 further including analyzing said change in impedance to determine if said change in impedance surpasses a predetermined impedance level.

12. The method of claim 11 further including displaying of impact location provided according to which sensor of said plurality of sensors transmitted said predetermined impedance level.

13. The method of claim 10 further including protecting said plurality of sensors with an impact absorbing layer.

14. An electronic system for detecting projectile impact locations, comprising:

a) a planar member having a pressure sensitive ink coating, b) said pressure sensitive ink coating producing a change in impedance when a force acts upon said pressure sensitive ink coating and a constant electrical current is applied on said pressure sensitive ink coating, c) said change in impedance is transferred to output electronics via conductive ink coating on said planar member, d) said output electronics connect to a display device, and e) a front layer providing a pattern on its front surface for targeting purposes.

15. The detection system of claim 14 wherein said display device is located next to said output electronics.

16. The detection system of claim 14 wherein said display device is located remotely connected by wires.

17. The detection system of claim 14 wherein said display device is located remotely connected by a wireless connection.

18. The detection system of claim 14 wherein said display device is connected through an internet protocol.

* * * * *